US007975387B2

(12) United States Patent
Mikula et al.

(10) Patent No.: US 7,975,387 B2
(45) Date of Patent: Jul. 12, 2011

(54) HAIR CUTTING DEVICE WITH HAIR LENGTH INDICATOR MEANS

(75) Inventors: Christian Mikula, Wernberg (AT); Bernhard Schratter, Klagenfurt (AT); Ernst Erich Petzl, Radenthein (AT)

(73) Assignee: Koninklijke Philips Electronics N.V., Eindhoven (NL)

( * ) Notice: Subject to any disclaimer, the term of this patent is extended or adjusted under 35 U.S.C. 154(b) by 61 days.

(21) Appl. No.: 11/917,900

(22) PCT Filed: Jun. 15, 2006

(86) PCT No.: PCT/IB2006/051931

§ 371 (c)(1),
(2), (4) Date: Dec. 17, 2007

(87) PCT Pub. No.: WO2006/134576

PCT Pub. Date: Dec. 21, 2006

(65) Prior Publication Data

US 2008/0196252 A1 Aug. 21, 2008

(30) Foreign Application Priority Data

Jun. 17, 2005 (EP) ..... 05105339

(51) Int. Cl.
*B26B 19/20* (2006.01)
*B26B 13/24* (2006.01)

(52) U.S. Cl. ..... 30/201; 30/202; 30/233

(58) Field of Classification Search ..... 30/200, 30/201, 202, 233, 286, 289
See application file for complete search history.

(56) References Cited

U.S. PATENT DOCUMENTS

| | | | | | |
|---|---|---|---|---|---|
| 178,093 | A | * | 5/1876 | Wiggins | 30/233 |
| 332,030 | A | * | 12/1885 | Young | 30/233.5 |
| 1,806,486 | A | * | 5/1931 | Mirafuentes | 30/233.5 |
| 3,969,819 | A | * | 7/1976 | Pepera | 30/200 |
| 3,979,825 | A | * | 9/1976 | Baumann | 30/133 |
| 4,054,991 | A | * | 10/1977 | Bahr | 30/231 |
| 4,428,124 | A | * | 1/1984 | Asakura | 33/334 |
| 4,669,189 | A | * | 6/1987 | Ullmann | 30/201 |
| 4,776,095 | A | * | 10/1988 | Tsujimoto et al. | 30/201 |
| 4,776,096 | A | * | 10/1988 | Chang | 30/233 |
| 4,868,987 | A | * | 9/1989 | Irving | 30/200 |
| 4,949,460 | A | * | 8/1990 | Sterk | 30/201 |
| 4,972,584 | A | | 11/1990 | Baumann | |

(Continued)

FOREIGN PATENT DOCUMENTS

DE 3200394 8/1982

(Continued)

*Primary Examiner* — Hwei-Siu C Payer
(74) *Attorney, Agent, or Firm* — Sherry Womack

(57) ABSTRACT

To provide a hair cutting device permitting the user to really know the remaining hair length without having to do trial cuts, a hair cutting device (1) with hair length indicator means (4) is proposed, wherein the hair length indicator means (4) comprises a fixed delimiter (5) and at least one movable delimiter (6) being movable with respect to the fixed delimiter (5), such that the hair length is indicated by the distance (D) between the fixed (5) and the at least one movable delimiter (6). Preferably, the hair length indicator means (4) comprises more than one movable delimiter (6, 7), all movable delimiters (6, 7) being movable in circumferential direction and functionally couplable with a comb unit (19, 20) such that a change between movable delimiters (6, 7) is caused by attachment of the comb unit (19, 20) to the hair cutting device (1).

10 Claims, 14 Drawing Sheets

U.S. PATENT DOCUMENTS

| | | | | | |
|---|---|---|---|---|---|
| 5,259,115 | A | * | 11/1993 | Bluder et al. | 30/201 |
| 5,327,648 | A | * | 7/1994 | Ullmann | 30/43.1 |
| 5,367,772 | A | * | 11/1994 | Ogawa | 30/201 |
| 6,079,103 | A | | 6/2000 | Melton et al. | |
| 6,968,623 | B2 | * | 11/2005 | Braun et al. | 30/201 |
| 2003/0056374 | A1 | | 3/2003 | Langley | |
| 2005/0044718 | A1 | | 3/2005 | Nakakura et al. | |

FOREIGN PATENT DOCUMENTS

| | | |
|---|---|---|
| DE | 3638872 | 5/1987 |
| DE | 3800966 | 7/1989 |
| WO | 9825734 | 6/1998 |

* cited by examiner

HAIR CUTTING DEVICE WITH HAIR LENGTH INDICATOR MEANS

The present invention relates to a hair cutting device, e.g. for trimming or clipping human or animal hair.

Hair cutting devices are widely used for cuffing hair, especially for short haircuts and clipping hair around the ears or for trimming beards. Dogs, e.g. poodles or other animals may be trimmed, too, with the help of a hair cutting device.

Generally used hair cutting devices have a cutting unit with e.g. two blades moved relatively to one another with help of a motor. The cutting device is normally mounted on a casing housing the motor or batteries as power supply for the hair cutting device. To define a certain cut length, a comb unit is mounted on the casing covering the cutting unit. The actual cutting length is defined by the length of the comb unit's teeth. The hair length is equivalent to the distance of the blades to the skin whereon the comb unit fixed on the casing is applied for cutting. To enlarge the range of usability of the clipping device, either different comb units having fins with various lengths and/or comb units adjustable with respect to the cutting unit are provided to allow for haircuts of different lengths.

Especially for non-professional users, there is the need for a clear and distinct indication of the actual cutting length or, in other words, of the remaining hair length after the cut.

U.S. Pat. No. 6,079,103 describes an adjustable attachment comb for use with a hair cutting device. It includes a stationary comb chassis that is configured and arranged to be removably attached to a hair cutting device and a movable comb body that is configured and arranged to be adjustably attached to the stationary comb chassis in one of a plurality of settings.

To indicate to the user, which of the settings has been selected, indicator windows are cut into the movable comb body. Numbers show through the windows indicating the setting number or the length the hair will be cut to, e.g. in mm. These numbers are marked on a substantially planar top surface of the stationary comb chassis. In case setting numbers, the user has to know the remaining hair length to each setting. In case of the hair length e.g. in mm, the user has no visual feedback about the remaining hair length. This makes the use of the hair cutting device quite complicated for non-professional users, who do not know the hair lengths corresponding to various settings and usually have no clear concept of the actual hair length corresponding to e.g. 15 mm or 20 mm. To really know what setting is the one they actually want, they still would have to check the possible setting by cutting some hair. Unfortunately, it is not always possible to do so without degrading the final hair cut.

It is therefore an object of the present invention to provide a hair cutting device permitting the user to really know the remaining hair length without having to do trial cuts.

This object is achieved by a hair cutting device with hair length indicator means, wherein the hair length indicator means comprises a fixed delimiter and at least one movable delimiter being movable with respect to the fixed delimiter, such that the hair length is indicated by the distance between the fixed delimiter and the at least one movable delimiter.

The delimiters may be any signs, symbols or marks etc. that indicate the starting point and the end point of a line, the line being equivalent to the hair length remaining after cutting. The hair length indicator means based on a fixed delimiter and at least one movable delimiter accommodates for various length settings, as the movable delimiter can be moved according to the actual setting to always indicate the correct hair length. Thus, the technical feature of having a fixed delimiter and at least one movable delimiter provides the user with the possibility to check the hair length very quickly and without the need of actually testing the cut length.

Preferably, the at least one movable delimiter is movable in longitudinal direction, i.e. the direction between cutting device and opposite end. This is especially advantageous for hair cutting devices with an elongated shape, because the hair length indicator means may be dimensioned to permit indication of larger range of possible hair lengths. Furthermore, during the cutting process, the line defined by the at least two delimiters is oriented in more or less the same direction as the hair to be cut, thus improving the visual feedback concerning the cutting result.

In preferred embodiments of the present invention, the at least one movable delimiter is functionally couplable with a comb unit. The utilization of a comb unit is the most usual way to define a certain cutting length. By providing coupling means for coupling the comb unit with the hair length indicator means, attaching the comb unit to the hair cutting device leads to an automatic movement of the at least one movable delimiter with respect to the fixed delimiter, such that the distance between the fixed delimiter and the at least one movable delimiter corresponds to the remaining hair length defined by the comb attached to the hair cutting device. Different comb units define different cutting lengths that are all translated in corresponding different distances between the fixed delimiter and the at least one movable delimiter of the hair length indicator means of the hair cutting device thanks to the functional coupling of comb unit and movable delimiter(s).

Preferably, the at least one movable delimiter is functionally couplable with an adjustable comb unit. The variation of length setting of the adjustable comb unit is directly translated by the functional coupling into the corresponding length being indicated by the hair length indicator means. Having thus an immediate visual feedback provided by the hair length indicator means concerning the remaining hair length during setting the cutting length with help of the adjustable comb unit makes use of the hair cutting device according to the invention much easier for the user.

If using more than one comb unit, it is advantageous to provide more than one movable delimiter depending of the cutting length range determined by each comb unit, be it adjustable or not.

In preferred embodiments of the present invention, the hair length indicator means comprises more than one movable delimiter, all movable delimiters being movable in circumferential direction. By moving the two or more movable delimiters in circumferential direction, the one or another movable delimiter faces the fixed delimiter and defines a line with the fixed delimiter equivalent to the remaining hair length. The choice of the movable delimiter to be used, i.e. the movement in circumferential direction depends on the range of various hair lengths to be indicated. In best case the whole area of the hair cutting device in circumferential direction may receive movable delimiters to provide a maximum number of movable delimiters.

Preferably, the more than one delimiters are functionally couplable with a comb unit such that a change between movable delimiters is caused by attachment of the comb unit to the hair cutting device. The functional coupling allows to automatically move the movable delimiters by attaching the comb unit and thus select the appropriate movable delimiter to cooperate with the fixed delimiter of the hair length indicator means. This is particularly useful when utilizing various adjustable comb units, each determining a different range of possible hair lengths.

It has shown advantageous, if the hair length indicator means comprises a plate element movable with respect to the fixed delimiter, the one or more movable delimiters being located on the plate element. Usage of a plate element simplifies mechanical coupling of the one or more movable delimiters with length setting means like comb units to indicate the remaining hair length in cooperation with the fixed delimiter.

In case of the hair length indicator means having more than one movable delimiter, it has shown advantageous, if the hair length indicator means comprises a lever element functionally coupled with the more than one movable delimiters and functionally couplable with a comb unit, such that, with attachment of the comb unit, the movable delimiters move in circumferential direction.

Preferably, the plate element and/or the lever element is coupled to a restoring element. This permits the movable delimiter cooperating for the moment with the fixed delimiter to move back into a start position, if the length setting means e.g. a comb unit is removed or one wants to change between different settings. This reduces errors in hair length indication, if subsequently another comb unit is attached to the hair cutting device.

It further simplifies the use of the hair cutting device according to the invention, if the hair length indicator means comprises a scale to quantify the hair length indicated by the hair length indicator means.

A detailed description of the invention is provided below. Said description is provided by way of a non-limiting example to be read with reference to the attached drawings in which.

The present invention will be described more in detail in relation to a trimmer with two detachable and adjustable comb units, one for shorter cut lengths and one for longer cut lengths. It will be noted, that the hair cutting device according to the present invention may also be realized with one or more nonadjustable combs, or with only one or three, four, five or more adjustable comb units.

Figure 1:
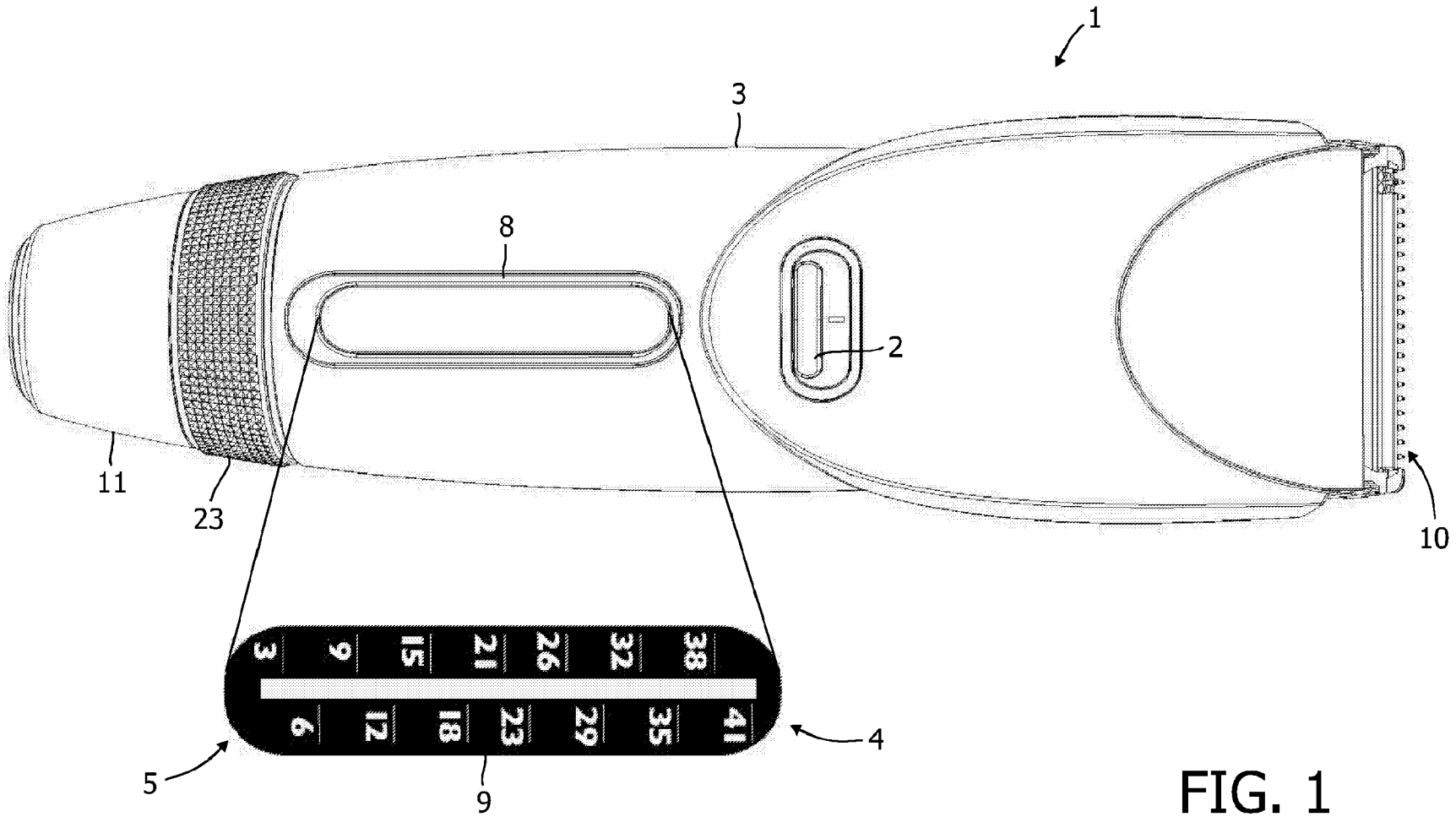
FIG. 1 shows a top view of a hair cutting device without comb unit.

FIG. 1 shows the trimmer 1 without comb unit. The trimmer 1 has two blades 10 that are moved relatively to one another with help of a motor (not shown) for cutting. The cutting unit of blades and motor is housed in casing 3 as well as batteries (not shown) as power supply. The trimmer 1 is switched on with help of the switch 2.

At the end opposite to the blades 10, there is a zoom ring 11 with a grip area 23. These are used to change the length setting of a comb unit, when it is attached to the trimmer 1, by turning the zoom ring 11 at the grip area 23.

In a window 8 of the casing 3 between the grip area 23 and the power switch 2 a hair length indicator 4 is provided. In the present situation, there is no movable delimiter, but only the fixed delimiter 5, i.e. the lower end of the scale 9, to be more precise, exactly the inner edge of the scale area being the border to the empty bar in the middle of the scale 9. That corresponds to a remaining hair length of 0 mm, because there is no comb unit and the distance between cutting blades 10 and skin of the head would be 0 mm as well, if the trimmer 1 would be applied on the head. Instead of an empty bar, it is also possible to have a message appear, e.g. "ATTENTION no comb".

It will be noted, that the scale 9 of the hair length indicator 4 is in millimeters, thus indicating the exact remaining hair length. Furthermore, for even better visual feed back for the user, the hair length indicator 4 is true to scale. The hair length indicator 4 is oriented in longitudinal direction to allow for a large range of values together with a good visibility.

Figure 2:
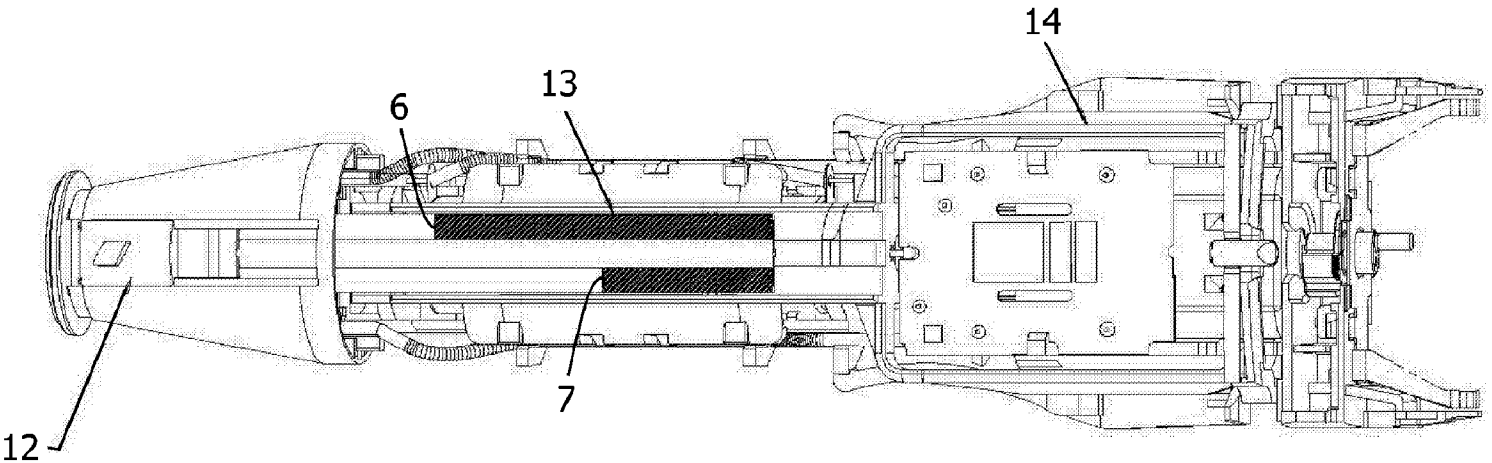
FIG. 2 shows a top view of the hair cutting device of FIG. 1 without casing and cutting unit.
Figure 3:
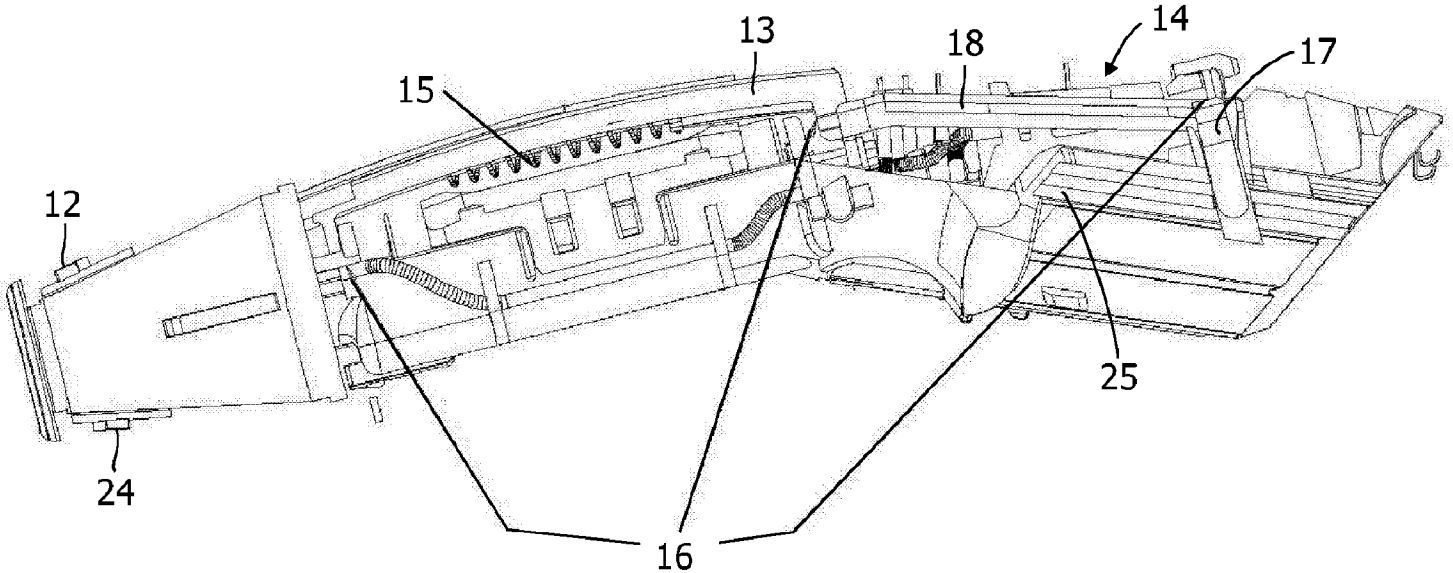
FIG. 3 shows a side view of the hair cutting device of FIG. 1 without casing and cutting unit.
Figure 4:
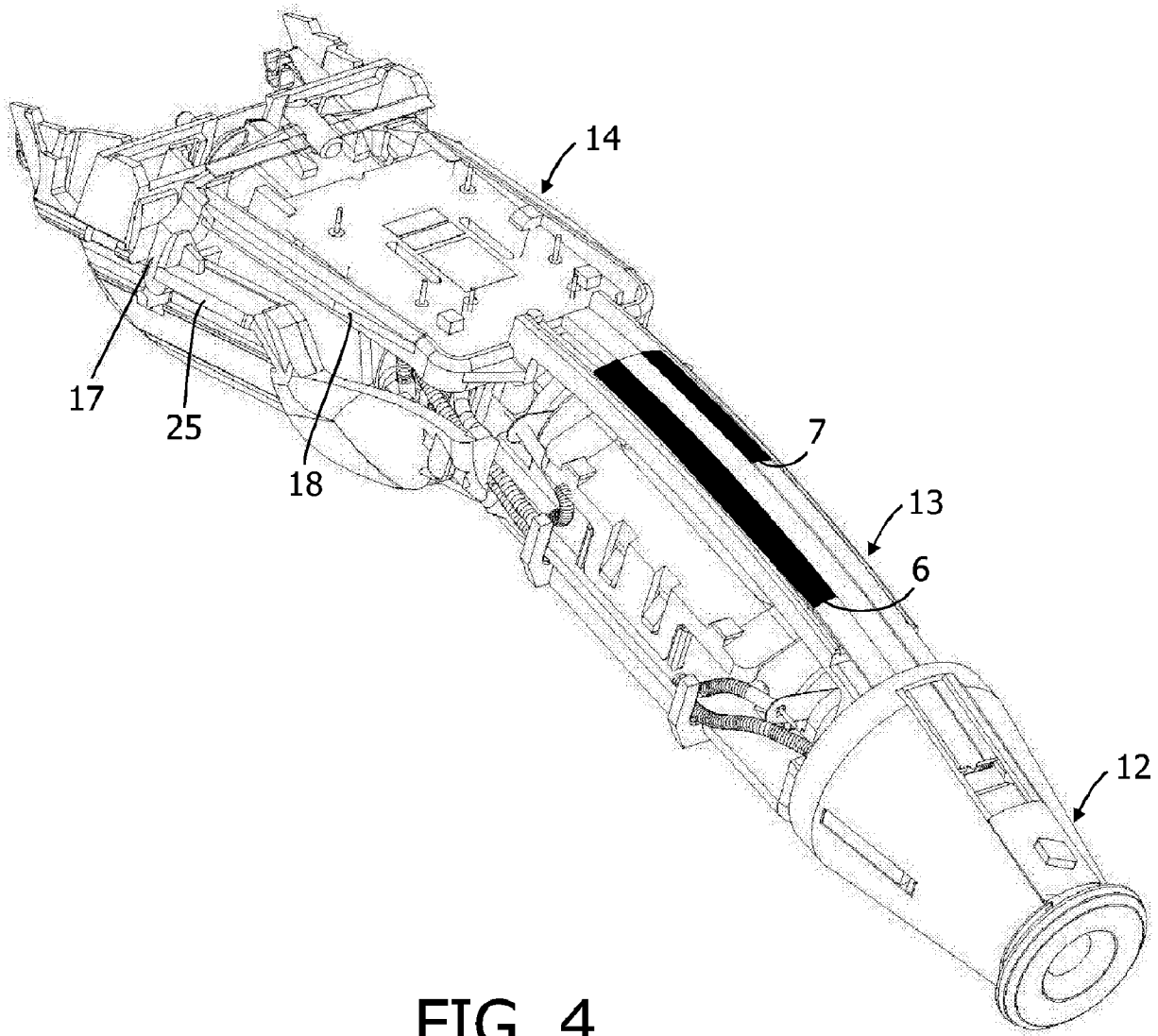
FIG. 4 shows a perspective view of the hair cutting device of FIG. 1 without casing and cutting unit.

FIGS. 2 to 4 show the trimmer without casing or cutting unit to illustrate, how a hair length indicator according to the present invention may, for example, be realized. The two main components are the plate 13 and the lever 14. On the plate 13 are located a first movable delimiter 6 to be used with the comb unit for shorter cuts and a second movable delimiter 7 to be used with the comb unit for longer cuts. In between is the empty bar to be used, when no comb unit is attached to the trimmer, as shown in FIG. 1.

The lever 14 includes on both sides a cam 17 and a lever arm 18. Via the lever arm 18, the lever 14 is coupled to the plate 13. If a comb unit is attached on the trimmer, i.e. on the lower arm 25, the cam 17 on the one or the other side is pushed up and the cam 17 on the opposite side moves down, depending on which comb unit is attached to the trimmer. This induces a pivoting movement in circumferential direction, clockwise or anticlockwise, of the lever 14 and the plate 13. The pivoting points are indicated by numeral 16. The circumferential movement of the plate 13 moves either the first 6 or the second movable delimiter 7 to the place of the empty bar and shows up in the visible part of the hair length indicator. The torsional tension induced in the lever arm 18 brings the lever 14 and with it the plate 13 back into the neutral position as soon as the comb unit is removed.

The movable delimiters 6, 7, i.e. the plate 13 is moved with help of the first slider 12. Simultaneously, the comb setting is changed with help of the second slider 24. Both sliders 12, 24 are actuated by the zoom ring of the casing. The plate 13 is pressed by the reset spring 15 against the first slider 12. Accordingly, the plate 13 will be moved forward or backward, depending on whether the length setting of the comb unit will be increased or decreased. When moving the plate 13, the movable delimiters 6, 7 move in longitudinal direction, too, and change their position with respect to the fixed delimiter.

Figure 5:
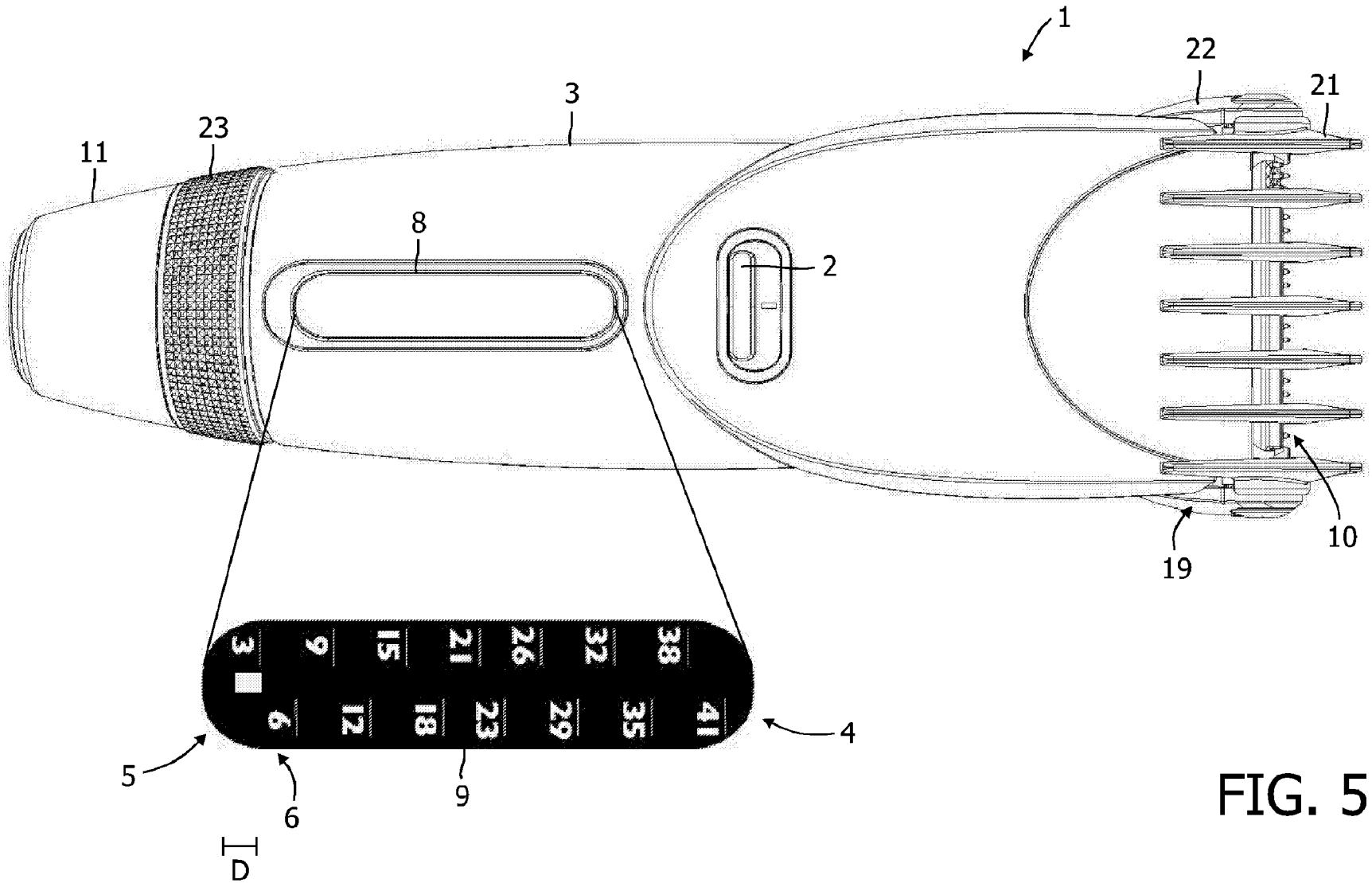
FIG. 5 shows a top view of a hair cutting device with a comb unit for short cuts in the position for the shortest possible length.

FIG. 5 shows the trimmer 1 with the comb unit 19 for shorter cuts attached. The comb unit 19 includes a chassis 22 for attachment to the trimmer 1 and the fins 21 defining the cut length. In the situation shown in FIG. 5, the setting of the comb unit 19 is the setting for minimum cut length. Accordingly, the hair length indicator 4 indicates a remaining hair length of 3 mm. The 3 mm are equivalent to the distance D between the fixed delimiter 5 and the movable delimiter 6, i.e. the inner edge of the scale area and the line delimiting the colored area from the black area in the inner part.

Figure 6:
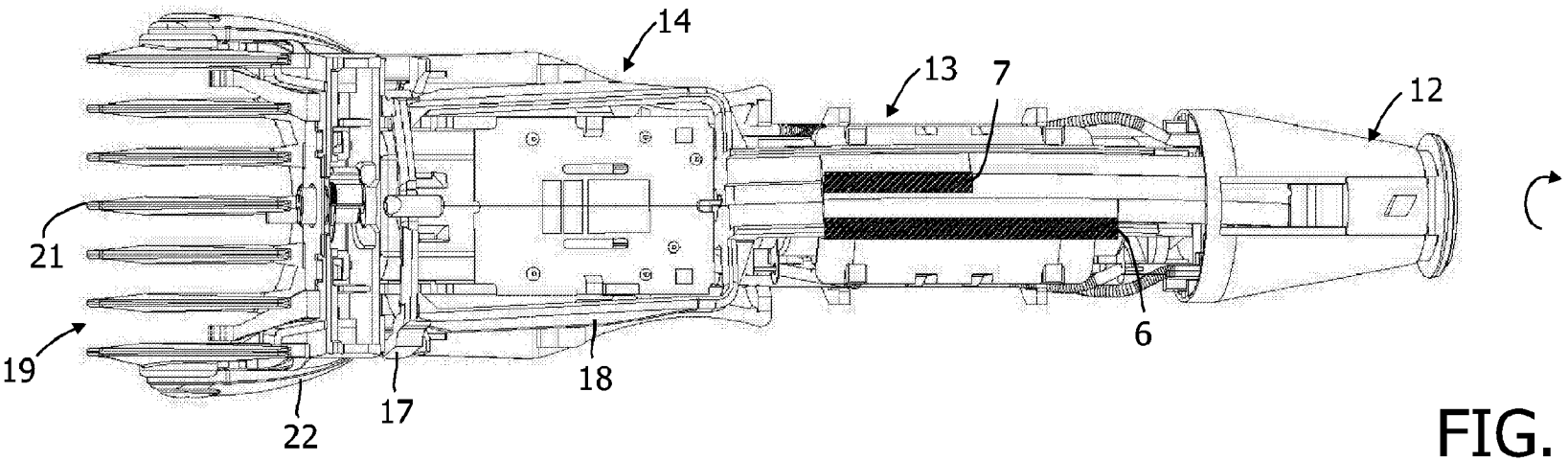
FIG. 6 shows a top view of the hair cutting device of FIG. 5 without casing and cutting unit.
Figure 7:
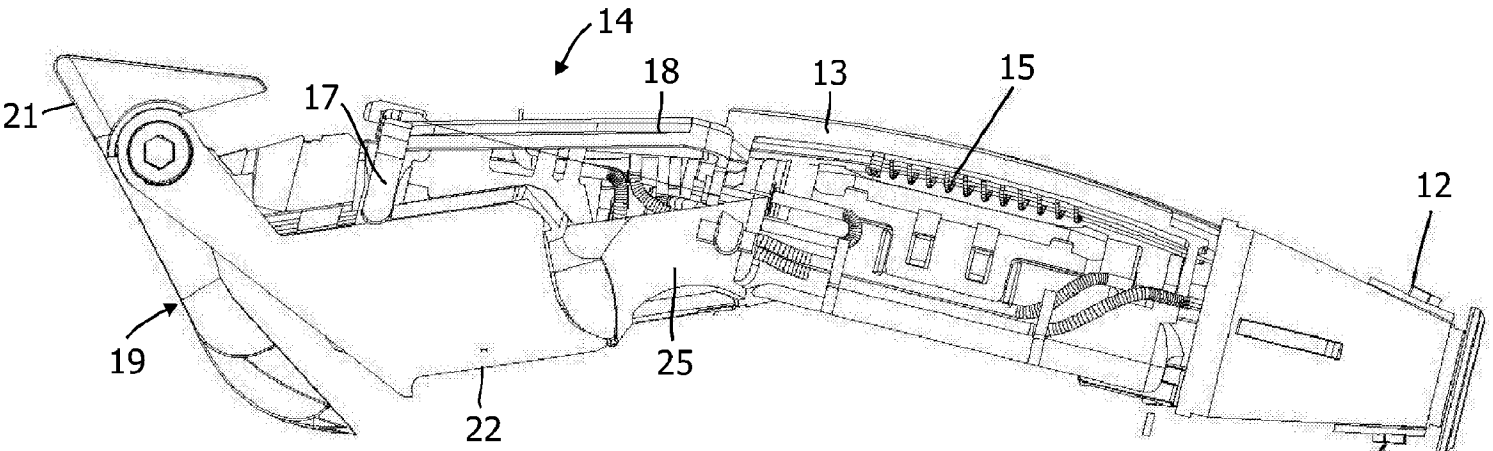
FIG. 7 shows a side view of the hair cutting device of FIG. 5 without casing and cutting unit.
Figure 8:
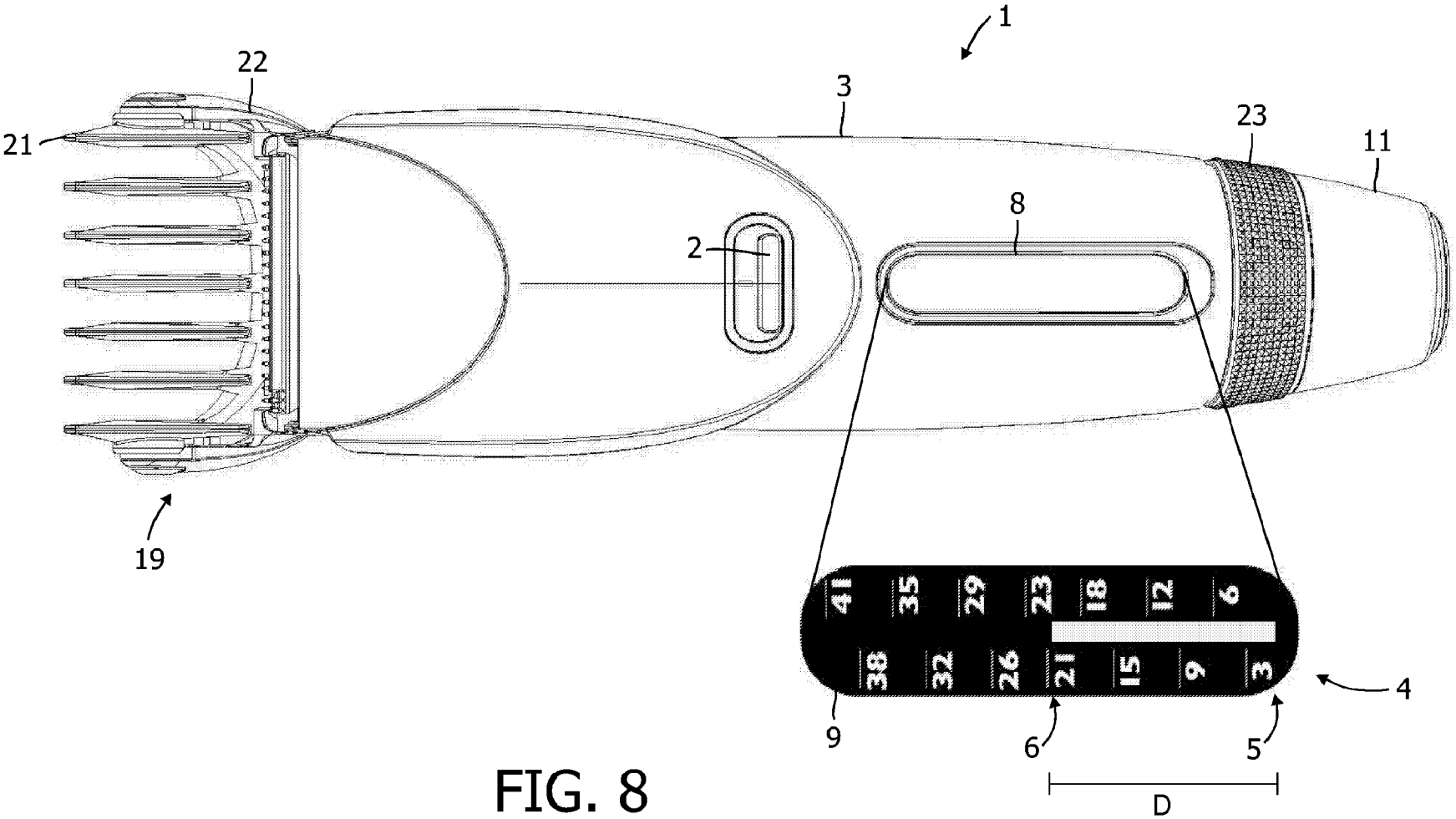
FIG. 8 shows a top view of a hair cutting device with a comb unit for short cuts in the position for the longest possible length.
Figure 9:
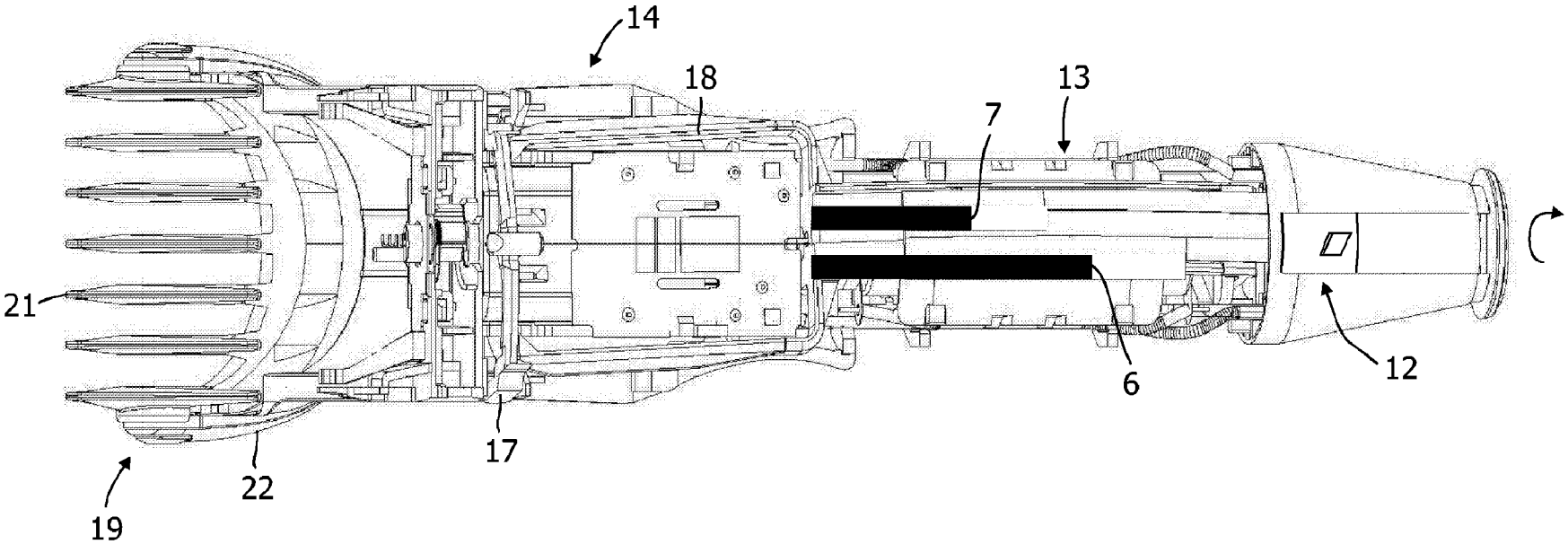
FIG. 9 shows a top view of the hair cutting device of FIG. 8 without casing and cutting unit.

FIGS. 6 and 7 show the trimmer of FIG. 5 without casing or cutting unit. Especially in FIG. 6 is visible, that the left cam 17 is pushed up by the chassis 22 of the comb unit 19. This induces a clockwise pivoting movement (see arrow in FIG. 6) of the lever 14 and the plate 13, thus moving the movable delimiter 6 into the visible part of the hair length indicator.

Figure 10:
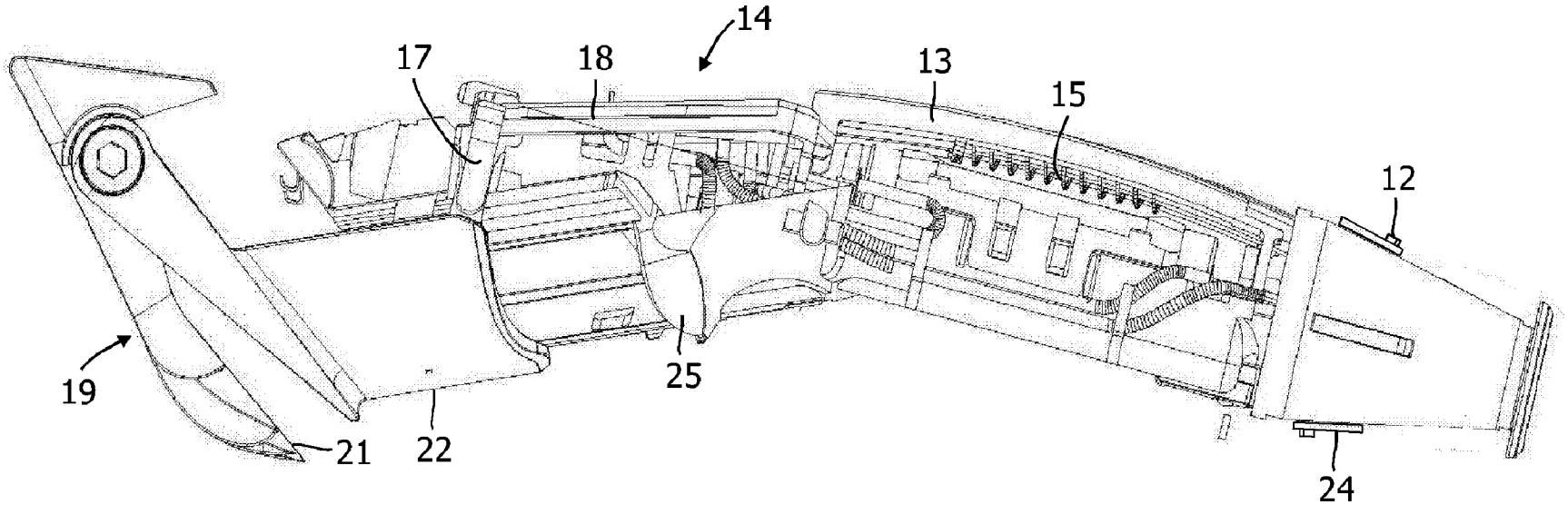
FIG. 10 shows a side view of the hair cutting device of FIG. 8 without casing and cutting unit.
Figure 11:
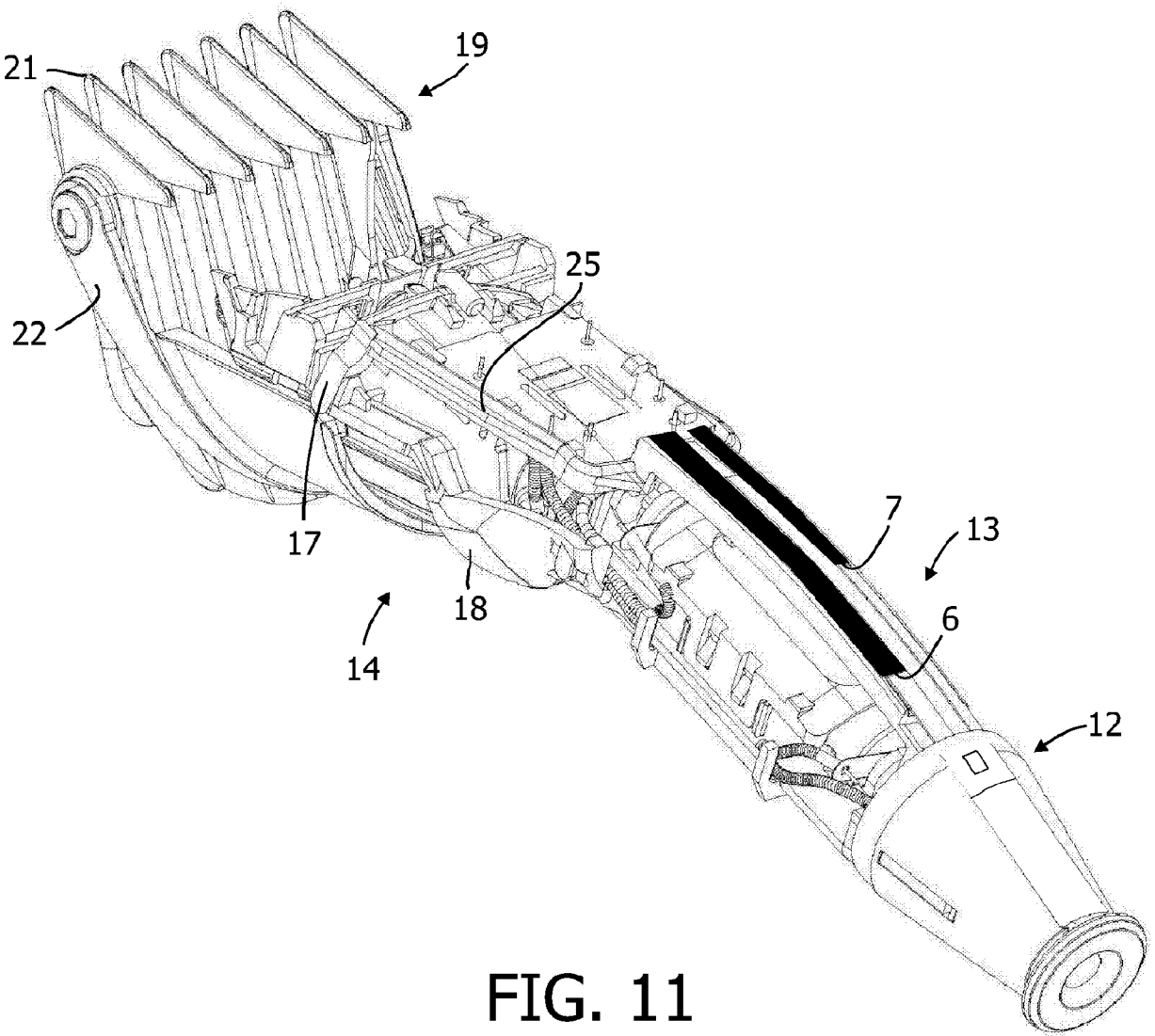
FIG. 11 shows a perspective view of the hair cutting device of FIG. 8 without casing and cutting unit.
Figure 12:
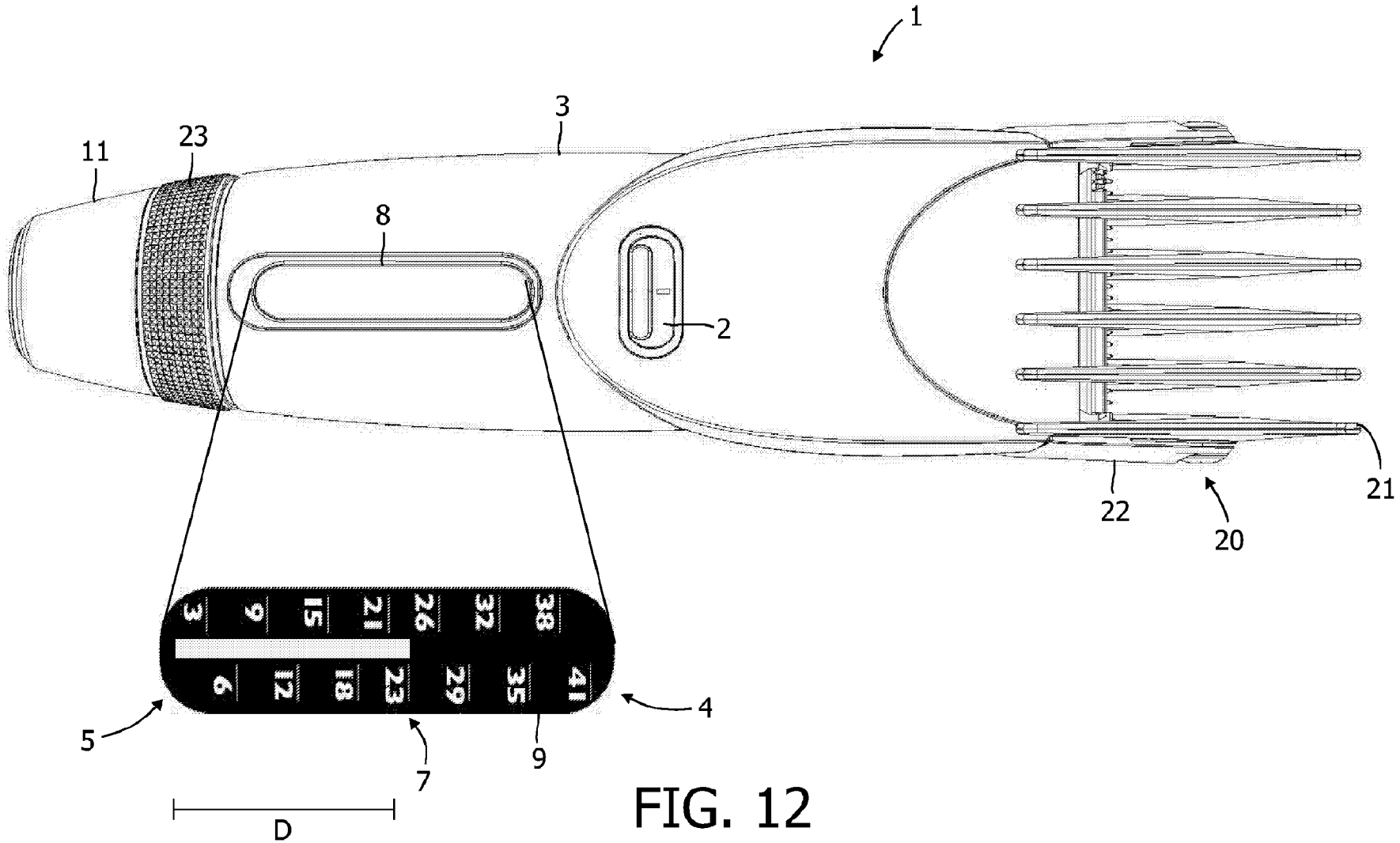
FIG. 12 shows a top view of a hair cutting device with a comb unit for long cuts in the position for the shortest possible length.
Figure 13:
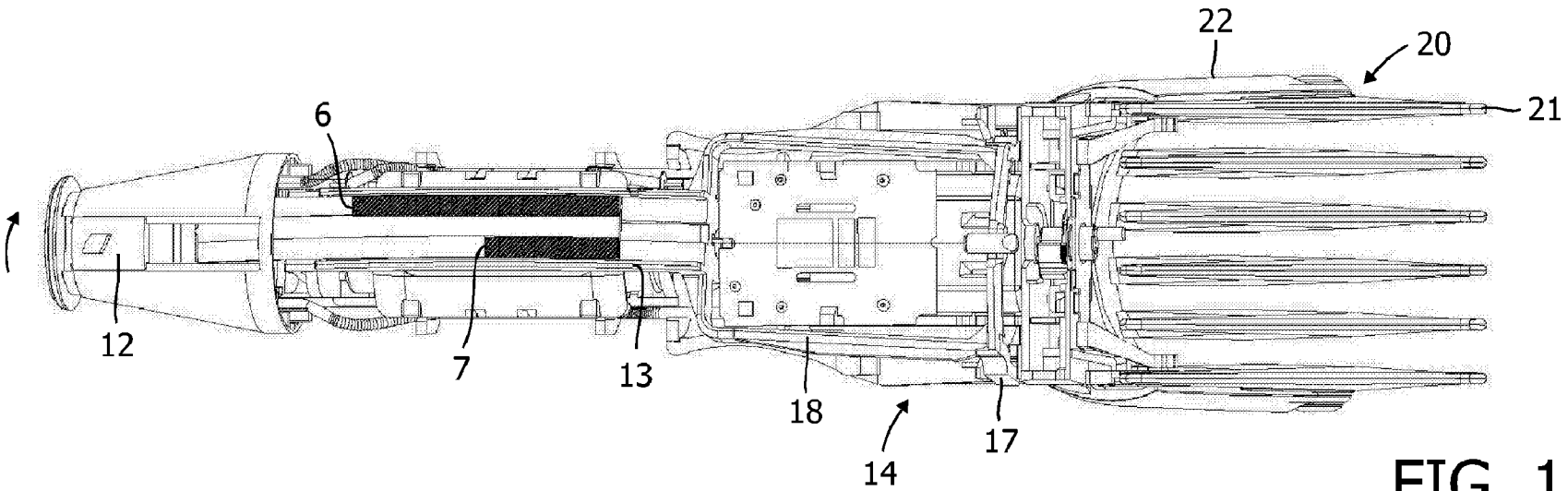
FIG. 13 shows a top view of the hair cutting device of FIG. 12 without casing and cutting unit.
Figure 14:
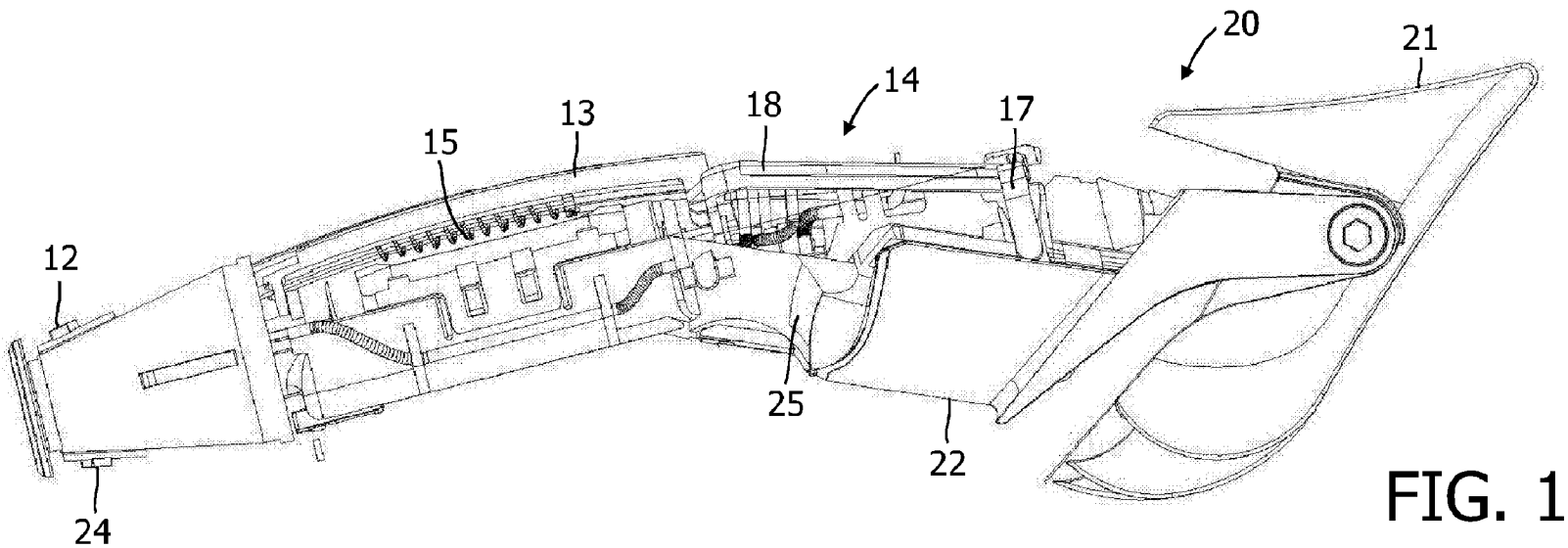
FIG. 14 shows a side view of the hair cutting device of FIG. 12 without casing and cutting unit.
Figure 15:
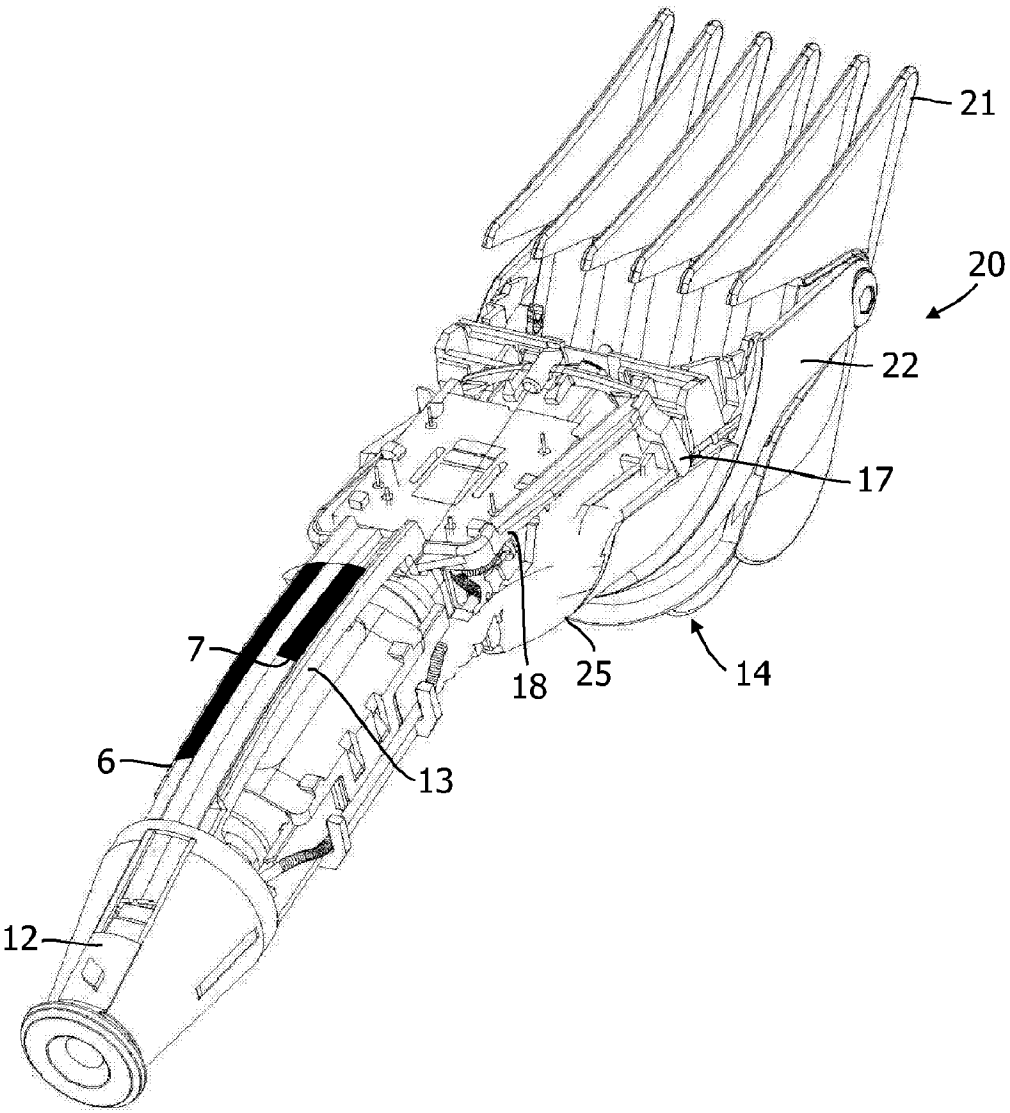
FIG. 15 shows a perspective view of the hair cutting device of FIG. 12 without casing and cutting unit.

FIGS. 8 to 11 show the trimmer 1 again with the comb unit for shorter cuts 19, but this time in the setting for maximum remaining hair length. As indicated by the hair length indicator 4, the remaining hair length is almost 21 mm. As can be seen in FIG. 10, to realize the maximum length setting, the comb unit 19, i.e. the chassis 22 of the comb unit 19 slides forward on the lower arm 25. Simultaneously, the plate 13 with the movable delimiters 6, 7 is pushed forward, too, thus indicating the longer remaining hair length.

Figure 16:
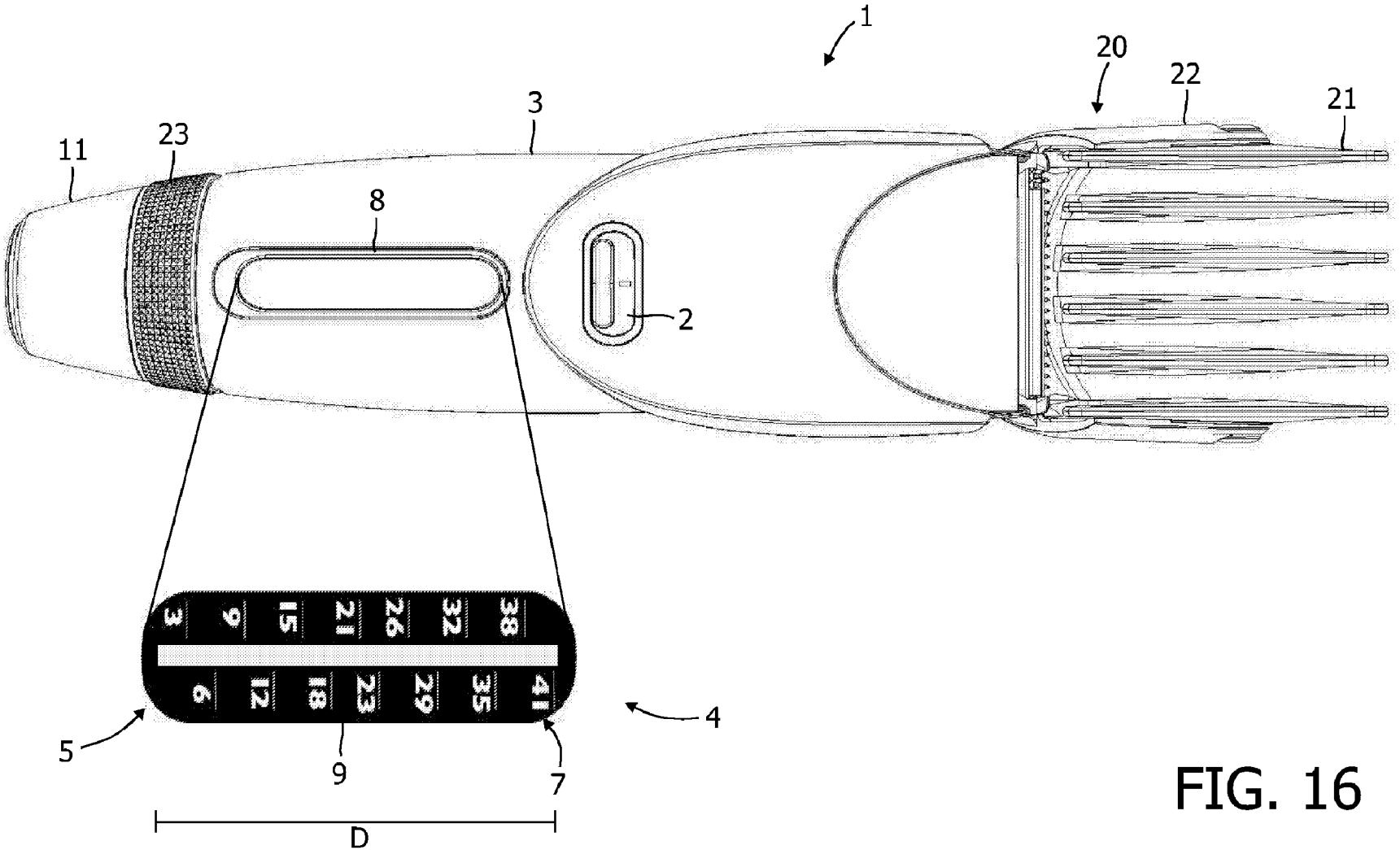
FIG. 16 shows a top view of a hair cutting device with a comb unit for long cuts in the position for the longest possible length.
Figure 17:
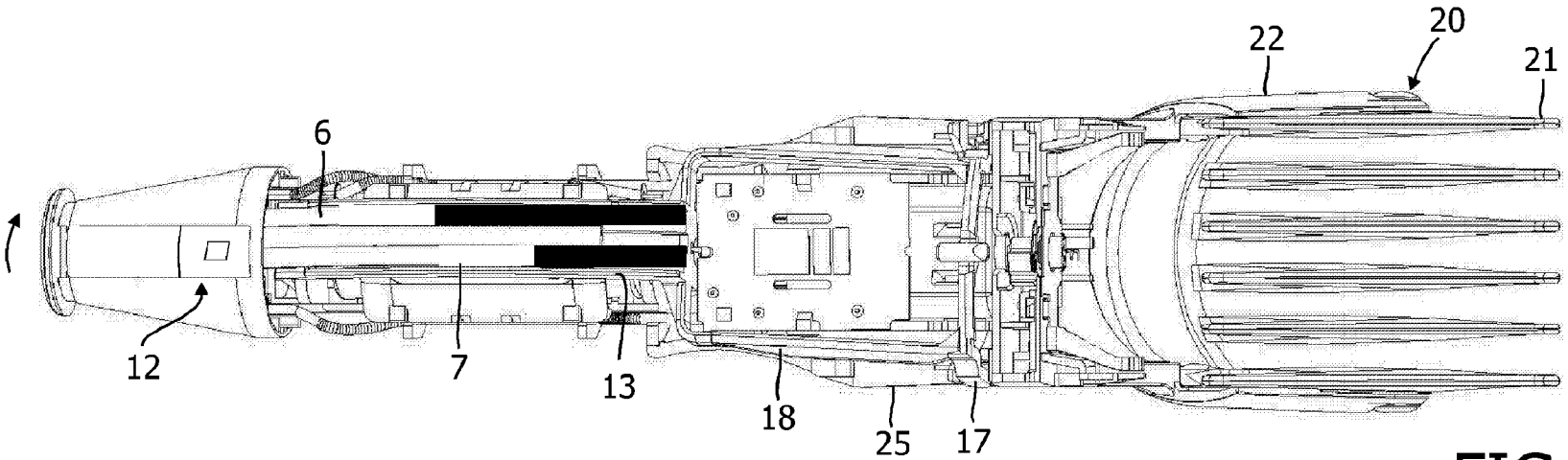
FIG. 17 shows a top view of the hair cutting device of FIG. 16 without casing and cutting unit.
Figure 18:
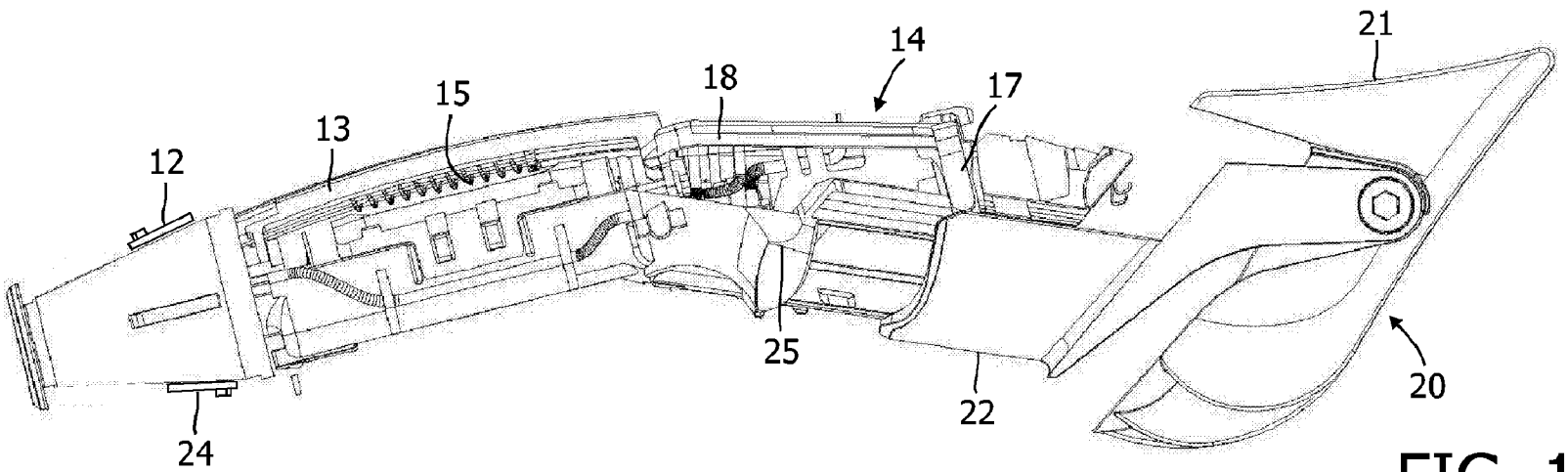
FIG. 18 shows a side view of the hair cutting device of FIG. 16 without casing and cutting unit.

FIGS. 12 to 15 and 16 to 18 show the equivalent situation for the trimmer 1 with the comb unit 20 for longer cuts, in the minimum length setting in the FIGS. 12 to 15 and in the maximum length setting in the FIGS. 16 to 18. These settings correspond to a remaining hair length indicated by the hair length indicator 4 of 23 mm (FIG. 12) and just over 41 mm (FIG. 16).

By attaching the comb unit 20 for longer cuts to the trimmer 1, the right cam 17 is pushed up by the chassis 22 of the comb unit 20. This induces an anticlockwise pivoting movement (see arrows in FIGS. 12, 17) and brings the second delimiter 7 into the visible part of the hair length indicator 4 to indicate the remaining hair length with respect to the fixed delimiter 5.

It will be noted, that the fixed and movable delimiters need not necessarily have the shape of a line. For example, the movable delimiter could be the tip of an arrow etc. Besides, it is also possible to have more than one comb unit cooperating with one movable delimiter.

It will further be noted, that the concept of having one indication means like the movable delimiter per one or several (adjustable) comb units, where the comb unit and the indication means are coupled such that the right indication means is chosen and the right length indicated may also be realized with indication means as known in the state of the art, e.g. windows with numbers.

Although having described several preferred embodiments of the invention, those skilled in the art would appreciate that various changes, alterations, and substitutions can be made without departing from the spirit and concepts of the present invention. The invention is, therefore, claimed in any of its forms or modifications with the proper scope of the appended claims. For example various combinations of the features of the following dependent claims could be made with the features of the independent claim without departing from the scope of the present invention. Furthermore, any reference numerals in the claims shall not be construed as limiting scope.

LIST OF REFERENCE NUMERALS

1 trimmer
2 power switch
3 casing
4 hair length indicator
5 fixed delimiter
6 first movable delimiter
7 second movable delimiter
8 window
9 scale
10 cutting blades
11 zoom ring
12 first slider
13 plate
14 lever
15 reset spring
16 pivoting points
17 cam
18 lever arm
19 comb unit for short cuts
20 comb unit for long cuts
21 fin
22 chassis
23 grip area
24 second slider
25 lower arm

The invention claimed is:

1. A hair cutting device, comprising:
a casing;
cutting blades; and
hair length indicator means,
wherein the hair length indicator means is contained in the casing and comprises a fixed delimiter and at least one movable delimiter being movable with respect to the fixed delimiter, such that a length of hair remaining after hair is cut is indicated by the distance between the fixed delimiter and the at least one movable delimiter, wherein the at least one movable delimiter comprises more than one movable delimiter, all movable delimiters being movable in a circumferential direction.

2. The hair cutting device according to claim 1, wherein the at least one movable delimiter is functionally couplable with a comb unit.

3. The hair cutting device according to claim 1, wherein the at least one movable delimiter is functionally couplable with an adjustable comb unit.

4. The hair cutting device according to claim 1, wherein the more than one movable delimiter is functionally couplable with a comb unit such that a change between the more than one movable delimiter and the fixed delimiter is caused by attachment of the comb unit to the hair cutting device.

5. The hair cutting device according to claim 1, wherein the hair length indicator means comprises a lever element functionally coupled with the movable delimiters and functionally couplable with a comb unit, such that, with attachment of the comb unit, the movable delimiters move in circumferential direction.

6. The hair cutting device according to claim 5, wherein the lever element is coupled to a restoring element.

7. The hair cutting device according to claim 1, wherein the hair length indicator means comprises a scale.

8. A hair cutting device, comprising:

a casing;

cutting blades; and hair length indicator means, wherein the hair length indicator means is contained in the casing and comprises a fixed delimiter and at least one movable delimiter being movable with respect to the fixed delimiter, such that a length of hair remaining after hair is cut is indicated by the distance between the fixed delimiter and the at least one movable delimiter, wherein the hair length indicator means comprises a plate element movable with respect to the fixed delimiter, the at least one movable delimiter being located on the plate element.

9. The hair cutting device according to claim 8, wherein the at least one movable delimiter is movable in a longitudinal direction.

10. The hair cutting device according to claim 8, wherein the plate element is coupled to a restoring element.

* * * * *